US006862793B2

(12) United States Patent
Frenken

(10) Patent No.: US 6,862,793 B2
(45) Date of Patent: Mar. 8, 2005

(54) RIVETING DEVICE AND METHOD FOR RIVETING

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 26 days.

(21) Appl. No.: 10/069,838

(22) PCT Filed: Jun. 29, 2001

(86) PCT No.: PCT/EP01/07483

§ 371 (c)(1),
(2), (4) Date: May 20, 2002

(87) PCT Pub. No.: WO02/00368

PCT Pub. Date: Jan. 3, 2002

(65) Prior Publication Data

US 2002/0148089 A1 Oct. 17, 2002

(30) Foreign Application Priority Data

Jun. 30, 2000 (DE) ..... 100 31 073

(51) Int. Cl.[7] ..... B23P 11/02

(52) U.S. Cl. ..... 29/525.06; 29/243.53; 29/816; 227/51

(58) Field of Search ..... 29/525.06, 524.1, 29/243.53, 816, 818, 798; 173/168, 169; 227/51

(56) References Cited

U.S. PATENT DOCUMENTS 3,747,194 A * 7/1973 Christensen ..... 29/243.54
4,096,727 A * 6/1978 Gargaillo ..... 72/312
4,365,401 A * 12/1982 Ogren ..... 29/243.53
4,384,667 A * 5/1983 Smallegan et al. ..... 29/798
4,516,448 A * 5/1985 Hill et al. ..... 83/137
4,878,284 A * 11/1989 Sawdon ..... 29/243.53
5,222,289 A * 6/1993 Michalewski et al. ..... 29/524.1
5,431,089 A * 7/1995 Sawdon ..... 92/90
5,752,305 A * 5/1998 Cotterill et al. ..... 29/525.06
6,041,493 A * 3/2000 Donhauser ..... 29/243.53
6,148,507 A * 11/2000 Swanson et al. ..... 29/816
6,398,096 B1 * 6/2002 Lang ..... 227/51
6,502,008 B2 * 12/2002 Maurer et al. ..... 29/716
6,543,115 B1 * 4/2003 Mauer et al. ..... 29/798
6,676,000 B2 * 1/2004 Lang et al. ..... 227/51

FOREIGN PATENT DOCUMENTS

DE 730 549 * 12/1942
DE 750 525 * 5/1944
DE 41 09 407 * 9/1992

* cited by examiner

*Primary Examiner*—David P. Bryant
(74) *Attorney, Agent, or Firm*—Trexler, Bushnell, Giangiorgi, Blackstone & Marr, Ltd.

(57) ABSTRACT

The invention relates to a riveting device (1) comprising a pressure pad (3) and a riveting die (4). Said pressure pad (3) and riveting die (4) can be hydraulically driven by means of a pressure pad piston (12) and a die piston (13). The aim of the invention is to further develop such a riveting device (1) in an advantageous manner. To this end, the pressure pad piston (12) and the die piston (13) are driven by the same hydraulic pressure, the effective piston area (36) of the pressure pad piston (12) being embodied in a smaller manner than the effective piston area (14) of the die piston (13).

11 Claims, 13 Drawing Sheets

Fig. 12
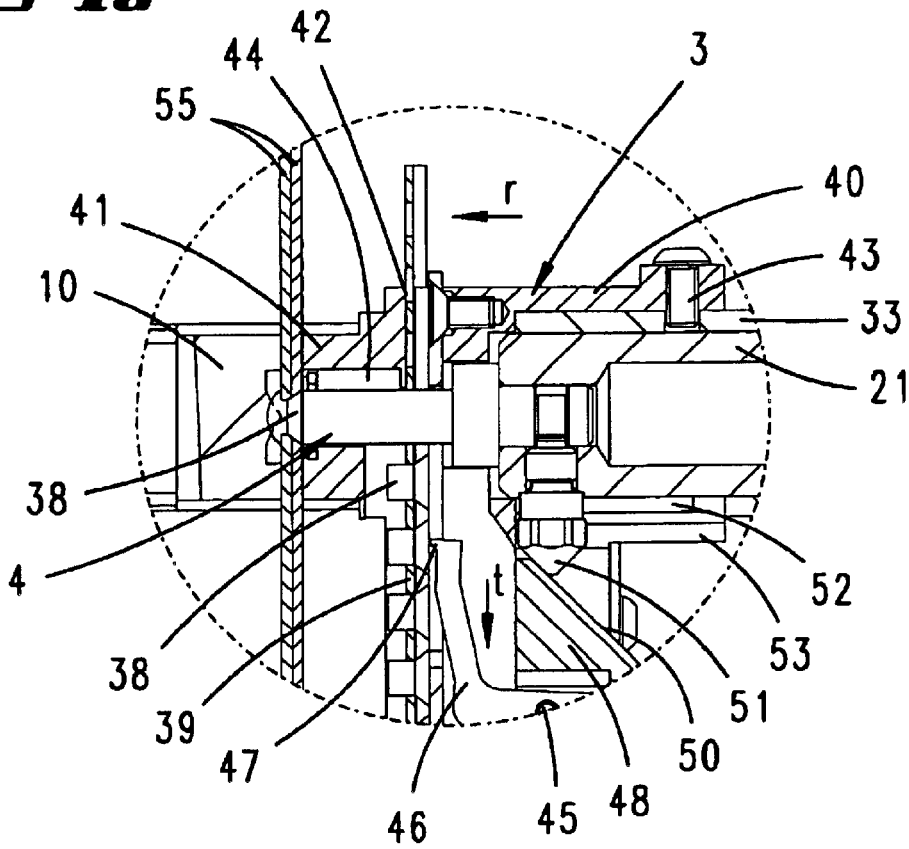
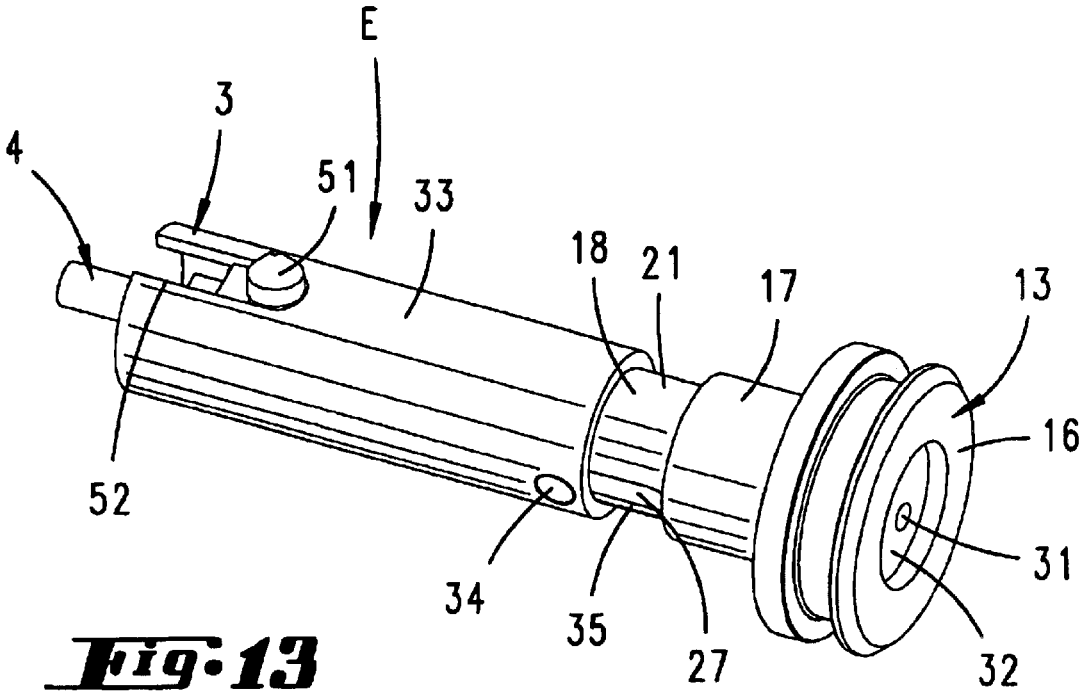
Fig. 13

RIVETING DEVICE AND METHOD FOR RIVETING

RELATED/PRIORITY APPLICATION

This application claims priority with respect to German Application No. 10031073.7, filed Jun. 30, 2000 and PCT Application No. PCT/EP01/07483, filed Jun. 29, 2001.

The invention relates first of all to a riveting unit with a holding-down means and a riveting die, it being possible for the holding-down means and the riveting die to be driven hydraulically by means of a holding-down piston and of a die piston.

Riveting units of the type in question are known and serve for connecting two usually sheet-like elements, for example metal sheets, by means of a rivet. The elements which are to be connected are fixed by a holding-down means, whereupon the elements are riveted by means of the riveting die.

In respect of the prior art described above, a technical problem of the invention is advantageously to develop a riveting unit of the type in question.

This problem is solved first and foremost by the subject matter of the claims of the present invention, this being based on the fact that the holding-down piston and tho die piston are activated by the same hydraulic pressure, the effective piston arca of the holding-down piston being formed to be smaller than the effective piston area of the die piston. As a result of this configuration, the riveting unit according to the invention may advantageously be operated with just one hydraulic piston for displacing both the holding-down piston and the die piston. It is thus possible, for example, for an electric motor-operated, hydraulic unit to be used for the hydraulic activation of the holding-down and die pistons. Such a unit is known, for example, from German Patent Application 198 25 160. The content of this patent application is hereby also included in full in the disclosure of the present invention, also for the purpose of incorporating features of this patent application in patent claims of the present invention. involved in the riveting function, for example the holding-down piston and the die piston, to be disposed in a mounting head for attachment to a unit which is configured as has been described above. The differently sized effective surface areas of the holding-down piston and die piston make it possible for the holding-down piston and die piston to be displaced separately by the same hydraulic pressure. By virtue of an increase in the pressure upstream of the piston, i.e. when operation of the riveting unit commences, first of all the holding-down piston—if appropriate with the die piston being carried along at the same time—is moved forward until the holding-down means reaches a position in which the elements which are to be connected are clamped in. The pressure which continues to act against the pistons thereafter causes the die piston to be displaced forward relative to the holding-down piston, in order for the riveting operation to be carried out. An advantageous development of the subject matter of the invention provides that the holding-down piston is disposed within the die piston, which is formed as an annular piston, and the holding-down piston is coupled to the holding-down means by engaging radially through the die piston. As a result of this configuration, the holding-down piston and the die piston are disposed concentrically in relation to one another, the selected arrangement resulting in the effective piston area of the holding-down piston being formed to be smaller, corresponding approximately to the annular-piston internal diameter, than the effective piston area of the die piston. The riveting region, i.e. the region through which the riveting die is to pass, is disposed centrally, the holding-down means enclosing this region concentrically. This realizes, in respect of the holding-down means, a changeover from the holding-down piston located on the inside to the holding-down means located on the outside and a changeover from the die piston located on the outside to the riveting die located on the inside. This is provided by the holding-down piston engaging radially, as specified, through the die piston in the outward direction for coupling to the holding-down means. It is thus possible, for example, for the holding-down piston to be provided with a drive pin which extends transversely to the movement direction of this piston and, passing through, for example, slots of the die piston, engages in corresponding bores of the holding-down means at both ends. This coupling preferably takes place in a region which does not have hydraulic oil or a similar medium passing through it, so that, correspondingly, no sealing problems are established here. It is further provided that the holding-down piston and the die piston are each biased into their starting position by means of a spring, the spring of the die piston being set to a stronger setting than the spring of the holding-down piston. The holding-down means and riveting die are preferably displaced rearward in reverse order. This rearward displacement takes place, for example, in the case of an arrangement on an electric-motor-operated, hydraulic unit of the type mentioned, as soon as a return valve in the unit opens on account of a predetermined maximum pressure having been exceeded and, thereafter, the restoring forces of the springs of the holding-down piston and die piston are greater than the hydraulic pressure acting on the corresponding piston areas. In this respect, it is further proposed that the springs are disposed concentrically in relation to one another. It is further provided that the die piston forms a central cylinder in which the holding-down piston is disposed, the restoring spring of the holding-down piston, furthermore, being supported against a pressure-exerting disk, which is disposed in the inlet region of the cylinder and leaves a through-passage. In the spring-assisted starting position, the holding-down piston is preferably positioned in a stop-limited manner in the die piston, which assists the operation of the die piston being carried along during the forward displacement of the holding-down piston in the direction of the clamping-in position of the elements which are to be connected. It is also proposed that the holding-down means and the riveting die are formed, over part of their length, as sleeve bodies which are disposed concentrically in relation to one another and can be displaced axially in relation to one another. As has been mentioned, the inlet region of the cylinder is provided with a pressure-exerting disk which leaves a through-passage. It may alternatively be provided that the cylinder in which the holding-down piston is guided has a hydraulic volume which is shut off in the outward direction by means of valves which preferably switch in a pressure-dependent manner. When a predetermined maximum pressure on the holding-down piston is exceeded, a correspondingly formed valve opens, through which the previously shut-off hydraulic volume can pass out for the displacement of the cylinder-containing die piston relative to the holding-down piston. It is preferred here that, in the position in which the riveting operation has been fully completed, the hydraulic volume in the cylinder has been more or less fully discharged via the valve. In the case of a following rearward displacement of this system on account of the decreasing hydraulic pressure upstream of the piston, spring-assisted displacement of the die piston relative to the holding-down piston leads to the previously discharged hydraulic volume being taken into the cylinder again upstream of the holding-down piston via a second valve. This configuration makes it possible for the valves to be used to set a holding-down force which is uniform until the riveting operation is carried out. The rivets which are to be pressed may be fed both individually and from a magazine or rivet chain. If the riveting unit is used, for example, on a robot, use may also be made of known tubular blowing-action feed means in order to feed the rivets.

The invention also relates to a riveting unit with a holding-down means and a riveting die in which there is a feed of rivets which are combined in a rivet chain. In order advantageously to develop a riveting unit of the type in question, there is provided an advancement pawl which runs over a rivet during a return movement and moves the rivet forward during an advancement movement, the return movement, furthermore, being derived from the movement of the riveting die. This configuration results in rivet transportation which is automated in dependence on the riveting operation. The forward displacement of the riveting die in order to carry out the riveting operation causes, according to the invention, a return movement of the advancement pawl into a standby position behind a further rivet, whereupon the return movement of the riveting die correspondingly initiates a forward feeding movement of the advancement pawl, with the rearwardly engaged rivet being carried along in the process, into a position in which a further rivet is located in the processing position, i.e. in axial extension of the riveting die. In accordance with the rivet size, it is also possible to change the diameter of the riveting die, thus, for example, by exchanging the same. In order to ensure, irrespective of the rivet size selected, that the next rivet is always fed from the rivet chain, it is provided that the riveting die displaced rearward for a riveting operation is not moved fully out of the movement path of the tip of the advancement pawl, this tip advancing the rivet, and, furthermore, the advancement movement of the advancement pawl is stop-limited by striking against the riveting die. As a result of this, the advancement distance of the advancement pawl is always such that the rivet brought into the operating position is brought into its correct position, in which it is aligned in axial extension of the riveting die. The advancement pawl is advantageously spring-biased here in the advancement direction. This spring biasing is overcome, during the rearward displacement of the advancement pawl, via the derived forward movement of the riveting die. It proves to be particularly advantageous that the advancement pawl, during displacement, interacts in each case with the rivet which is next to be processed. No forward feeding is required as a result of this configuration, so that it is even possible to process the last rivet in a rivet chain. A development of the subject matter of the invention provides that the advancement pawl is mounted on an advancement carriage, and that the advancement carriage can be moved substantially at right angles to the riveting die, from the movement of which the return movement of the advancement pawl is derived. It proves to be advantageous in this respect that the advancement carriage has a control surface, acting against which is a disengagement element for disengaging the advancement carriage. As a result of this configuration, a forward displacement of the riveting die, by activation of the disengagement element, coupled to the latter, along the control surface, causes the advancement carriage, and thus the advancement pawl, to be displaced preferably at right angles to the die-movement direction, the advancement pawl in the process simultaneously running over the next rivet in the rivet chain. It is preferred here that the control surface runs approximately along the angle bisector between the movement direction of the riveting die and of the advancement carriage, which, in the case of a preferred movement of the advancement carriage at right angles to the riveting-die movement, results in a control surface inclined approximately at 45° in relation to the riveting die movement direction. Furthermore, it is also advantageous for the advancement carriage to have a handle for the manual disengagement of the advancement carriage, so that manual actuation can be used to bring the next rivet into the operating position or to remove the rivet chain from the chain mount, which mounts the advancement pawl in a rotatable manner.

The invention also relates to a riveting unit with a holding-down means, a riveting die and a rivet anvil. In order advantageously to develop such a riveting unit, it is proposed that the rivet anvil has two joining wings which can be moved in opposite directions to one another and engage over the rivet anvil, in the process leaving between them a spacing corresponding to the diameter of the riveting die. This configuration provides a riveting unit of the type in question in which a press-joining system for the rivet-free connection of two elements is realized. A preferred configuration here is one in which the joining wings are mounted in a moveable manner on the rivet anvil about pins transverse to the movement direction of the riveting die. The rivet anvil here forms a female die for carrying out the material-joining operation. It is also proposed that, during the downward movement of the riveting die, the joining wings are displaced by means of the material of the elements which are to be connected to one another being displaced by the riveting die, the spacing between these joining wings being increased in the process. It is preferable here for the joining wings to be pivoted such that their sections which, at least in part, engage over the rivet anvil in a basic position are moved outward in opposite directions to one another, the spacing between these joining-wing sections being increased in the process. The pivotability of these joining wings is limited, i.e. stop-limited, and the wings serve for limiting in the lateral direction the displaced material of the elements which are to be connected to one another. A type of dovetail joining is realized, in cross section, as a result of the selected configuration. The joining wings, in addition, are spring-biased preferably into their basic position, i.e. into the position with the smallest spacing between them. A further configuration of the subject matter of the invention provides that, during the displacement, the joining wings dig into the material of the elements which are to be connected in part counter to the movement of the riveting die.

The invention additionally relates to a method of riveting two sheet-like elements by means of a riveting device, in particular of a riveting unit as claimed in one or more of the claims which has a holding-down means and a riveting die, first of all the holding-down means being brought into abutment against the elements and then the riveting die pressing a rivet into the elements, connecting the latter in the process, or joining the elements directly to one another. In order to advantageonsly improve a method of the type in quotation, it is proposed that the holding-down force is increased in dependence on the riveting-die force, but to a lesser extent. In this respect, it further proves to be advantageous for the holding-down force to be increased starting from a level which initially exceeds the riveting-die force. As a result of this configuration, during a riveting operation, the holding-down force initially selected is of such a magnitude that precise positioning of the elements which are to be connected is ensured and there is then an increase in the riveting-die force beyond the level of the holding-down force for the purpose of carrying out the riveting operation.

Finally, the invention relates to a method of joining two sheet-like elements by means of a riveting device, in particular of a riveting unit as claimed in one or more of claims 19 to 22, the elements being joined, without using a rivet, merely by deformation by means of the riveting die, and a rivet anvil which acts as an abutment, furthermore, being provided. In order to provide an advantageous development in respect of such a method, it is proposed that the rivet anvil is moved in the opposite direction at least in part as the riveting die is pressed down, it being the case that two joining wings of the rivet anvil, which can be moved in opposite directions to one another and engage over the rivet anvil in the basic position, in the process leaving between them a spacing corresponding to the diameter of the riveting die, are displaced, during the riveting operation, by means of the material of the elements which are to be connected to one another being displaced by the riveting die, the spacing between these joining wings being increased in the process. It proves to be particularly advantageous here for the elements, in the joining region, to be pressed into a radially openable rivet-anvil opening.

The invention is explained in more detail hereinbelow with reference to the attached drawing, which merely illustrates a number of exemplary embodiments, and in which:

FIG. 12 shows the enlargement of the region XII—XII in FIG. 11;

FIG. 13 shows a perspective illustration solely of an element which contains the holding-down means and the riveting die;

Figure 1:
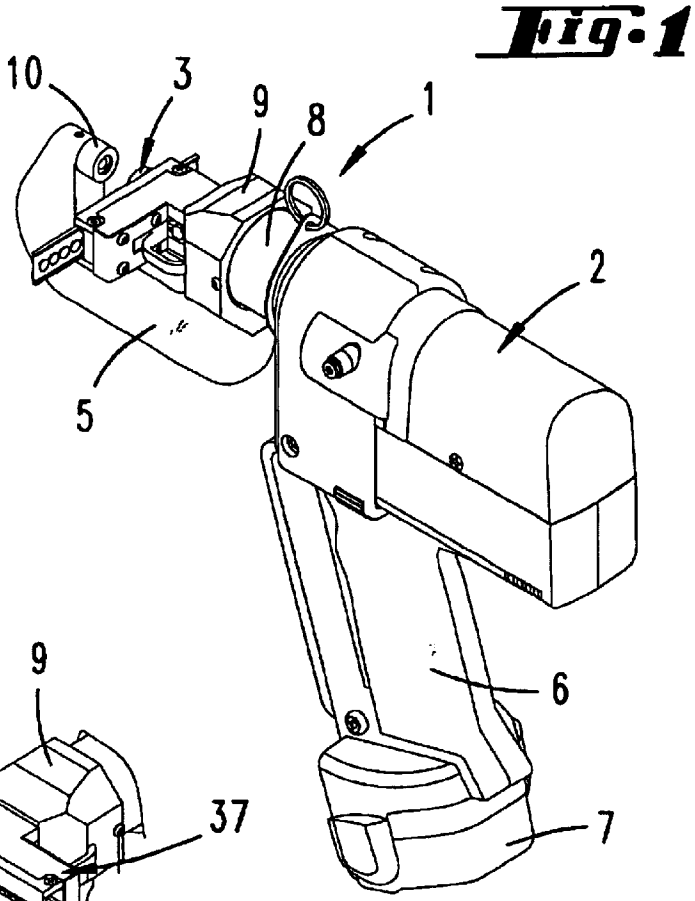
FIG. 1 shows a perspective illustration of a riveting unit according to the invention in a first embodiment.
Figure 2:
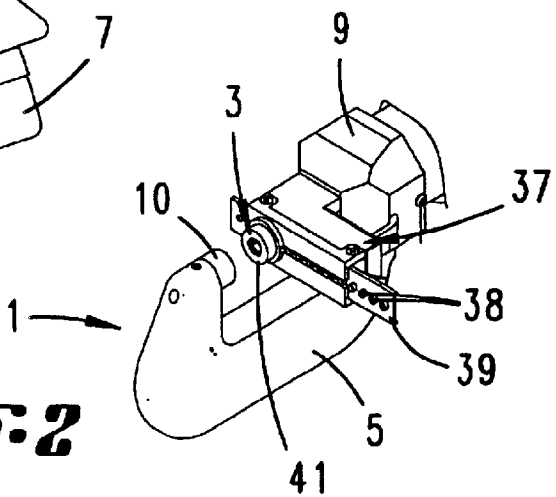
FIG. 2 shows a perspective illustration of part of the riveting unit, relating to the region of a rivet mounting head.
Figure 3:
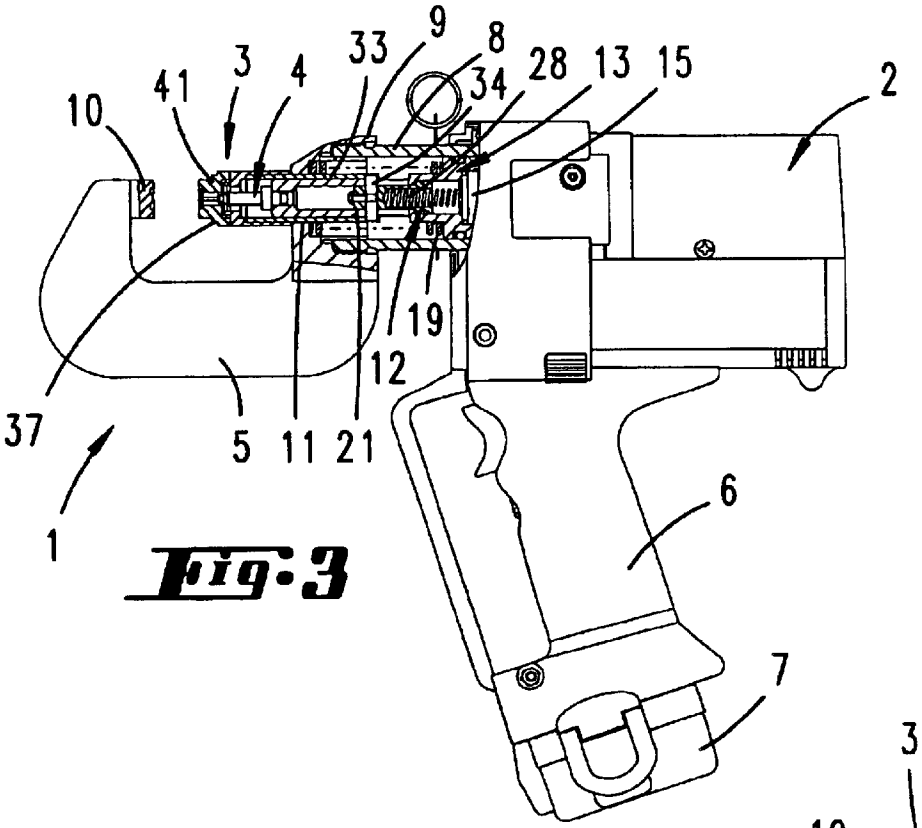
FIG. 3 shows a partially sectioned view of the riveting unit.

A riveting unit 1, substantially comprising an electric-motor-driven, hydraulic operating unit 2 and a mounting head 5, substantially containing a holding-down means 3 and a riveting die 4, will be illustrated and described first of all with reference to FIG. 1.

An electric motor is disposed in the operating unit 2. This electric motor is driven via a storage battery 7 integrated in a handle 6. Upon actuation of a finger-actuable switch, oil is pumped into a pressure chamber from a supply chamber, as a result of which a hydraulic cylinder (not illustrated specifically) is moved, counter to the action of a restoring spring, in the direction of its operating end position.

The hydraulic cylinder is moved back via a restoring spring as soon as a return valve opens on account of a predetermined maximum pressure being exceeded.

As an alternative to the operating unit illustrated in FIG. 1, it is also possible to use a hand-actuable operating unit, in which case, in order to build up the required pressure, the displacement of the hydraulic cylinder is effected not by an electric motor but in a manually actuated manner via a pumping lever.

Irrespective of the formation of the operating unit 2, the latter has a neck 8 which surrounds the hydraulic cylinder and on which the mounting head 5 can be disposed. The mounting head 5 is preferably selected such that rotation of the same on the neck 8 is ensured.

The mounting head 5 is of substantially C-shaped form, the C-opening forming the riveting region. One C-leg, in order for the mounting head 5 to be disposed on the neck 8, is of cup-like form with a circular cross-section and thus forms a mount 9, the internal diameter of which is adapted to the external diameter of the neck 8.

That C-leg of the mounting head 5 which is located opposite the mount 9 carries a preferably exchangeable rivet anvil 10 which forms a female die and the body axis of which runs in extension of the axis of the mount 9.

Furthermore, along the mount axis X—X, the holding-down means 3 and the riveting die 4 are secured in a displaceable manner in the mount 9, for which purpose the mount 9 has an axial through-passage 11.

The holding-down means 3 and the riveting die 4 are activated by the same pressure built up by means of the hydraulic cylinder driven in the operating unit, for which purpose the holding-down means 3 has a holding-down piston 12 and the riveting die 4 has a die piston 13.

The die piston 13 here has an external diameter adapted to the internal diameter of the neck, a piston ring seal 14 ensuring the sealing termination of the pressure chamber 15 in the neck 8, which pressure chamber is formed upstream of the die piston 13 and is to be subjected to the action of the hydraulic cylinder of the operating unit 2.

On the side which is directed away from the piston surface 16, the die piston 13 continues in a reduced-diameter piston section 17, which is adjoined by a further cross-sectionally reduced section 18, which passes through the mount 9 in the region of the through-passage 11 of the same.

In axial extension of the second section 18, the riveting die 4, oriented in the direction of the rivet anvil 10, is mounted on, for example screw-connected to, this second section.

Figure 4:
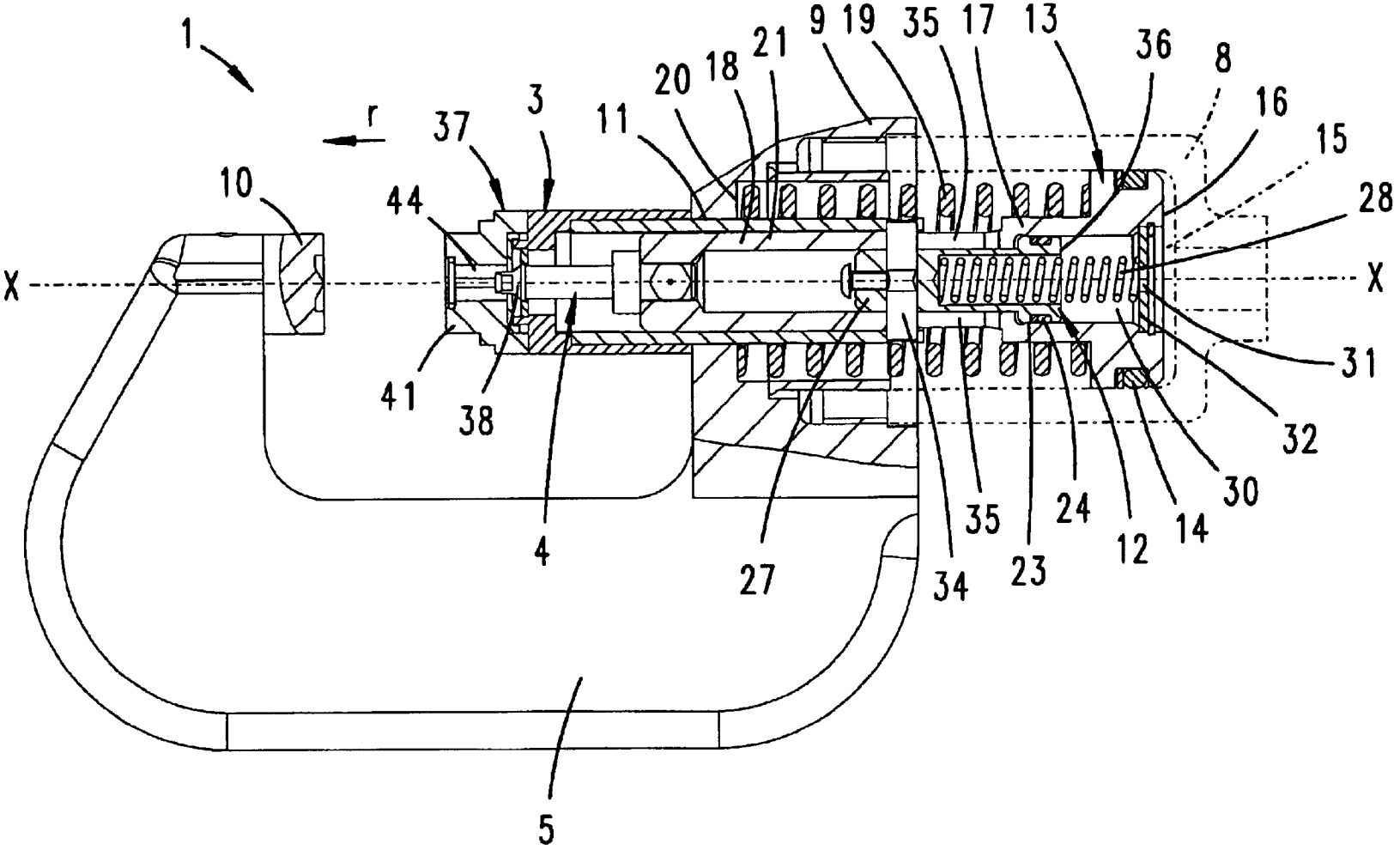
FIG. 4 shows the partially sectioned rivet mounting head with the mount of the riveting unit represented in chain-dotted lines manner.
Figure 5:
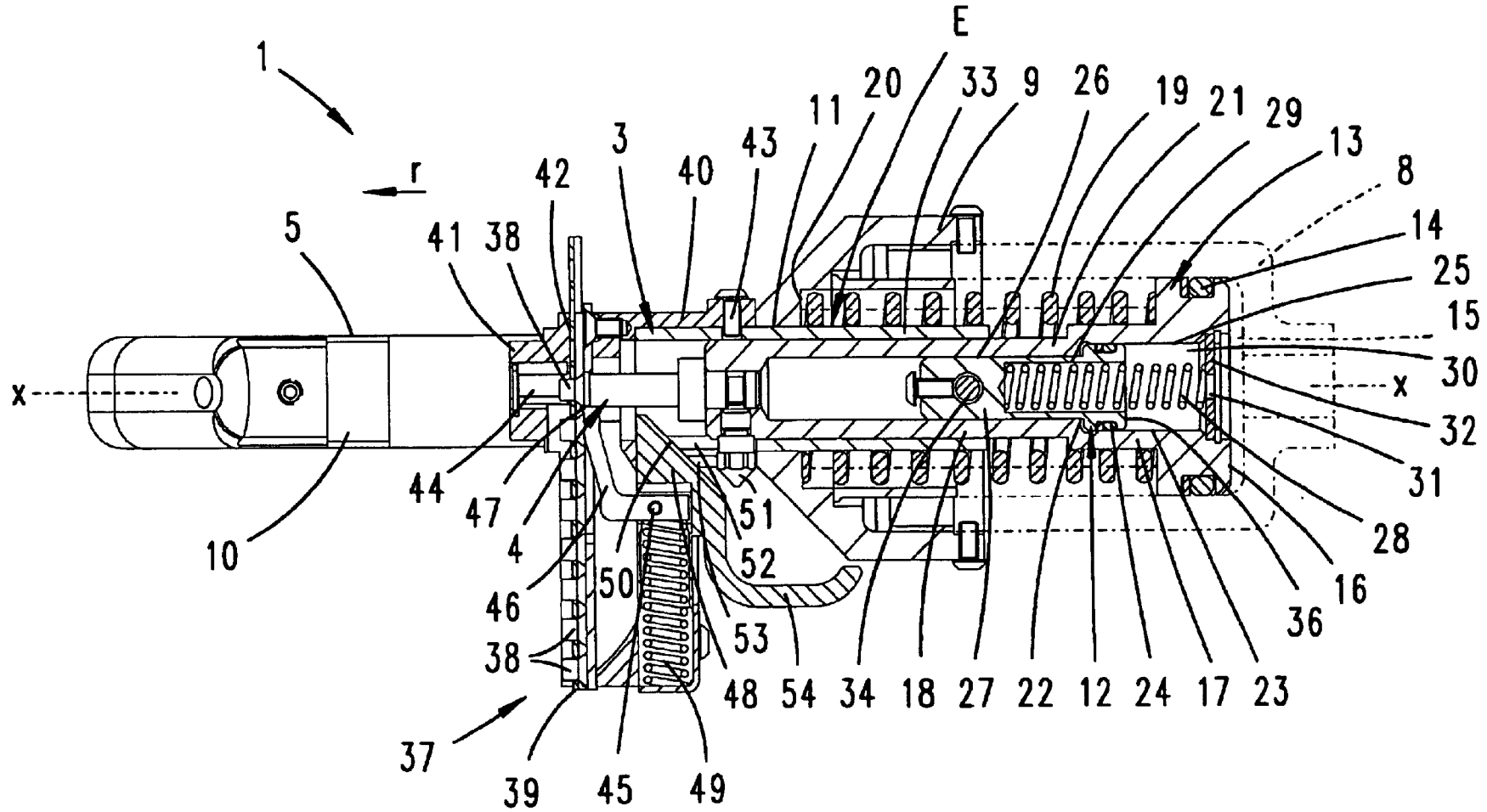
FIG. 5 shows the partially sectioned plan view in respect of FIG. 4, relating to the riveting unit in the non-loaded, basic position.

The riveting die 4 and the die piston 13 are biased into the starting position according to FIGS. 4 and 5 by means of a compression spring 19 which surrounds the first section 17 and the second section 18, which spring 19 is supported, at one end, on the rear side of the die piston 13 and, at the other end, on the base of an inner annular step 20 in the vicinity of the through-passage 11 of the mount 9.

The die piston 13 or the sections 17 and 18 thereof is/are formed as a sleeve body 21, as a result of which a central cylinder 23 provided with an annular step 22 is formed. The holding-down piston 12 is mounted in an axially displaceable manner in this cylinder 23, this with the holding-down piston 12 and die piston 13 being disposed concentrically. The holding-down piston 12, which is provided with a piston ring seal 24, is positioned in a section 25, which passes through the region of the die piston 13 and the region of the first sections of the die piston 13 and is of largest cross-section, and is supported, in the starting position according to FIGS. 4 and 5, on the annular step 22 formed between this cylinder section 25 and the adjoining, cross-sectionally reduced section 26. The body 27 of the holding-down piston 12 projects into this cross-sectionally reduced cylinder section 26 in the region of the second die-piston section 18, the length of this piston body corresponding approximately to half the axial length of the cylinder section 26.

In the starting position according to FIGS. 4 and 5, the holding-down piston 12 is biased against the annular step 22 by means of a compression spring 28, which compression spring 28 is supported, at one end, on the base of a central holding-down-piston bore 29 and, at the other end, on a pressure-exerting disk 32, which covers the pressure chamber 30, formed in the region of the cylinder section 25 upstream of the holding-down piston 12, but leaves a central through-passage 31.

The holding-down means 3 is formed as a sleeve body 33 which surrounds the second section 18 of the die piston 13 and has an external diameter which is adapted to the diameter of the through-passage 11 of the mount 9. This ensures reliable axial guidance of the sleeve body 33 or of the holding-down means 3 in the mount 9 and, furthermore, reliable axial guidance of the cross-sectionally adapted second section 18 of the die piston 13 in the sleeve body 33 or the holding-down means 3.

The holding-down means 3 or the sleeve body 33 forming the same is connected to the holding-down piston 12 for drive action via a drive bolt 34, which drive bolt 34 is aligned transversely to the overall axis x—x and, passing through the body 27 of the holding-down piston 12, engages with its free ends in correspondingly formed drive bores of the sleeve body 33. The sleeve body 21 of the die piston 13 has the drive bolt 34 passing through it in the region of two appropriately disposed slot bores 35.

As a result of this configuration, the riveting die 4, which passes through the center of the holding-down means 3 and is thus located on the inside, is coupled to an outer die piston 13 and the outer holding-down means 3 is coupled to an inner holding-down piston 12. This results in the effective piston area 16 of the die piston 13 being formed to be greater than the effective piston area 36 of the holding-down piston 12.

Furthermore, the spring 19 of the die piston 13 is set to a stronger setting than the spring 28 of the holding-down piston 12, this with the two springs 19 and 28 disposed concentrically in relation to one another.

By virtue of the selected arrangement, the holding-down means 3 and the riveting die 4 or the sleeve bodies 21 and 33 thereof, over part of their length, are disposed concentrically in relation to one another and can be displaced axially in relation to one another.

A device 37 is mounted on the holding-down means 3 in the region of its free end, which is directed toward the rivet anvil 10, which device 37 serves for feeding rivets 38 which are to be processed. The latter are secured in a rivet chain 39 made of a plastics material. The rivet chain 39 passes through the device 37 in the direction transverse to the movement direction r of the holding-down means 3 or of the riveting die 4 through a slit 42 formed in the region of a holding-down head 41 which is directed toward the rivet anvil 10 and is disposed between a cup-like mount 40, engaging over the free end of the holding-down means 3, and a rearwardly-directed surface of the holding-down head 41.

The device 37 is secured on the holding-down means 3 or on the sleeve body 33 by means of a screw 43 which passes through the mount 40. The holding-down head 41 is provided with a central rivet through-opening 44.

In the starting position according to FIGS. 4 and 5, the riveting die 4 projects into the region of the device mount 40, in the process leaving a spacing between the end surface of the riveting die and the rivet 38, located in a standby position, which is to be processed.

For the purpose of feeding the rivets 38, i.e. for displacing one of the rivets 38 which is to be processed into the axial position in relation to the riveting die 4, there is provided in the device 37 an advancement pawl 46 which can be pivoted about a pin 45 and has an advancement tip 47 at its free end, directed toward the rivet chain 39.

The advancement pawl 46 is mounted rotatably on an advancement carriage 48, which carriage 48 can be displaced with sliding action in the device 37 and is biased into its starting position according to FIGS. 4 and 5 by means of a compression spring 49. The movement direction of the advancement carriage 48 and/or the advancement pawl 46 counter to the spring force is indicated by the arrow t.

The advancement carriage 48 has a control surface 50 which runs approximately along the angle bisector between the movement direction r of the riveting die 4 and the movement direction t of the advancement carriage 48. This control surface 50 interacts with a pin-like disengagement element 51 of the riveting die 4 or of the sleeve body 21 thereof, for which purpose the disengagement element 51, which projects radially from the riveting die 4 or the sleeve body 21, passes through an open-edge slot opening 52 of the sleeve body 33 of the holding-down means and a correspondingly disposed slot 53 of the device mount 40. It is likewise the case that the advancement carriage 48 engages through the abovementioned slots 52, 53 at least in part by way of its control surface 50, as a result of which the control surface 50 is located in the movement direction r of the disengagement element 51.

The advancement carriage 48 also has a handle 54 for disengaging the same manually.

The first embodiment of the riveting unit 1 illustrated in FIGS. 1 to 13 functions as follows:

By virtue of switch actuation on the operating unit 2, the hydraulic cylinder is moved in the direction of its operating end position in the operating unit 2, which results in a pressure increase in the pressure chamber 15. As a result of this, the holding-down piston 12, which contains the smaller effective piston surface area 36, is moved in movement direction r, the die piston 13 being carried along via the annular step 22 in the process. Correspondingly, the holding-down means 3 and the riveting die 4 as well as the rivet-feeding device 37, disposed on the holding-down means 3, move uniformly in the direction of the rivet anvil 10 until they reach a position according to FIG. 6, in which the holding-down means 3 or the holding-down head 41 of the device 37 strikes against the rivet anvil 10, with the interposition of the elements 55, for example metal sheets, which are to be connected. This forward displacement of the holding-down means/riveting die unit E, which is illustrated on its own in FIG. 13, takes place counter to the force of the spring 19 acting on the die piston 13.

Figure 6:
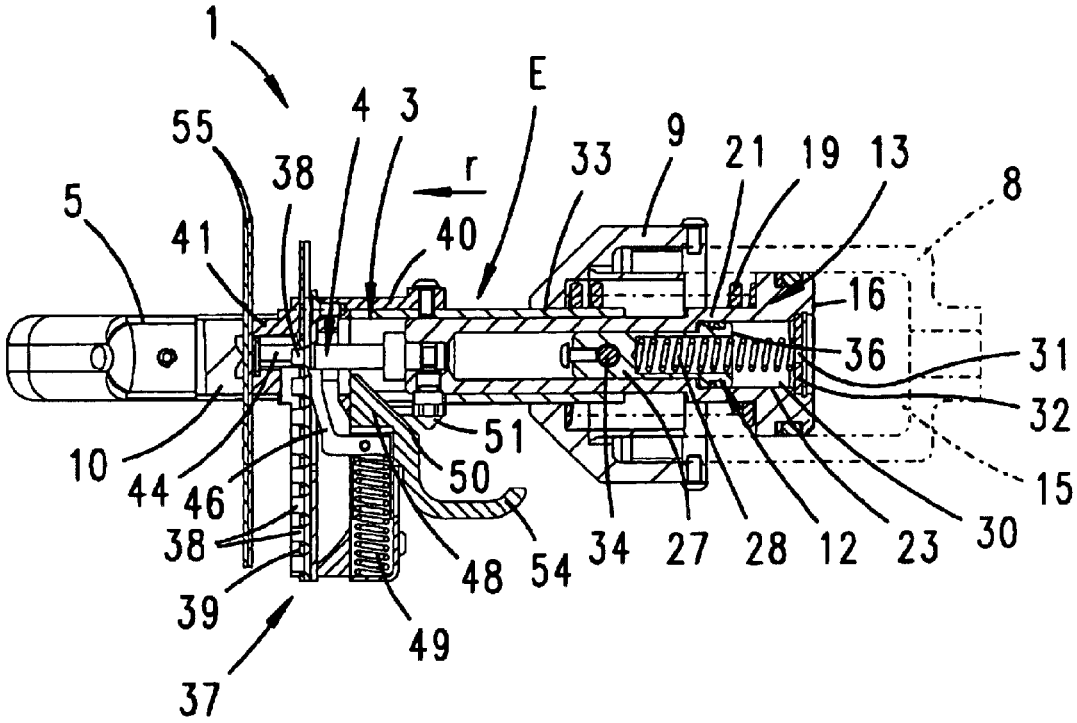
FIG. 6 shows an illustration corresponding to FIG. 5, but illustrating a holding-down means displaced forward before the operation of securing two elements which are to be connected.
Figure 7:
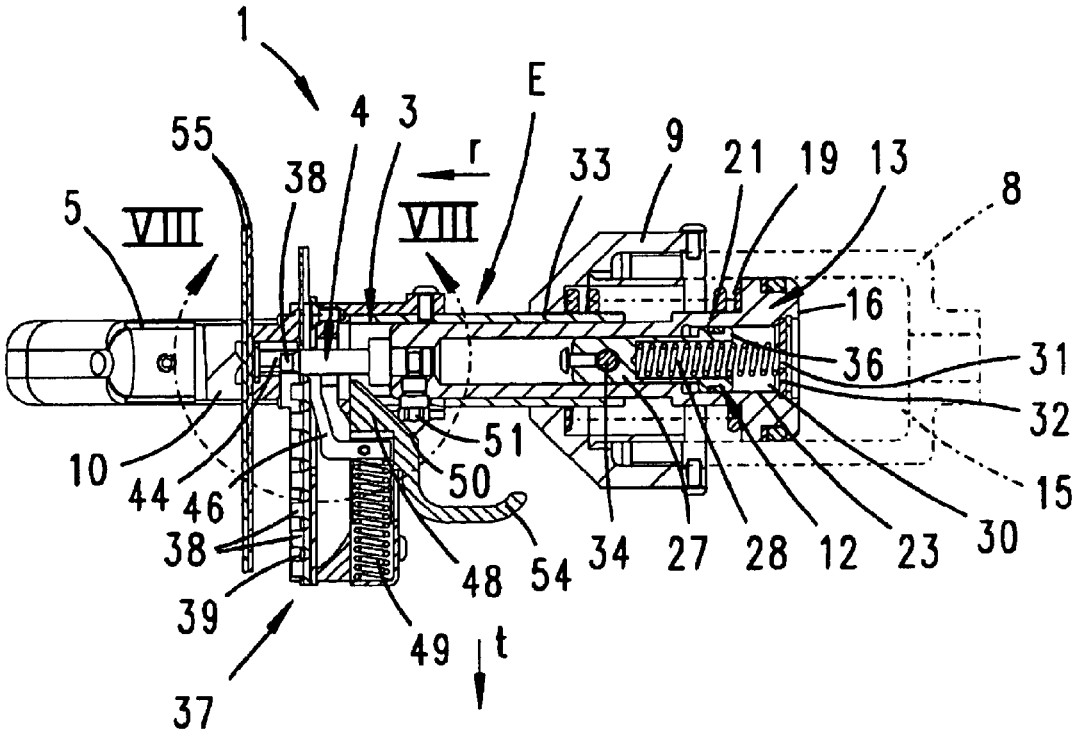
FIG. 7 shows a follow-up illustration to FIG. 6 during the forward displacement of a riveting die.
Figure 8:
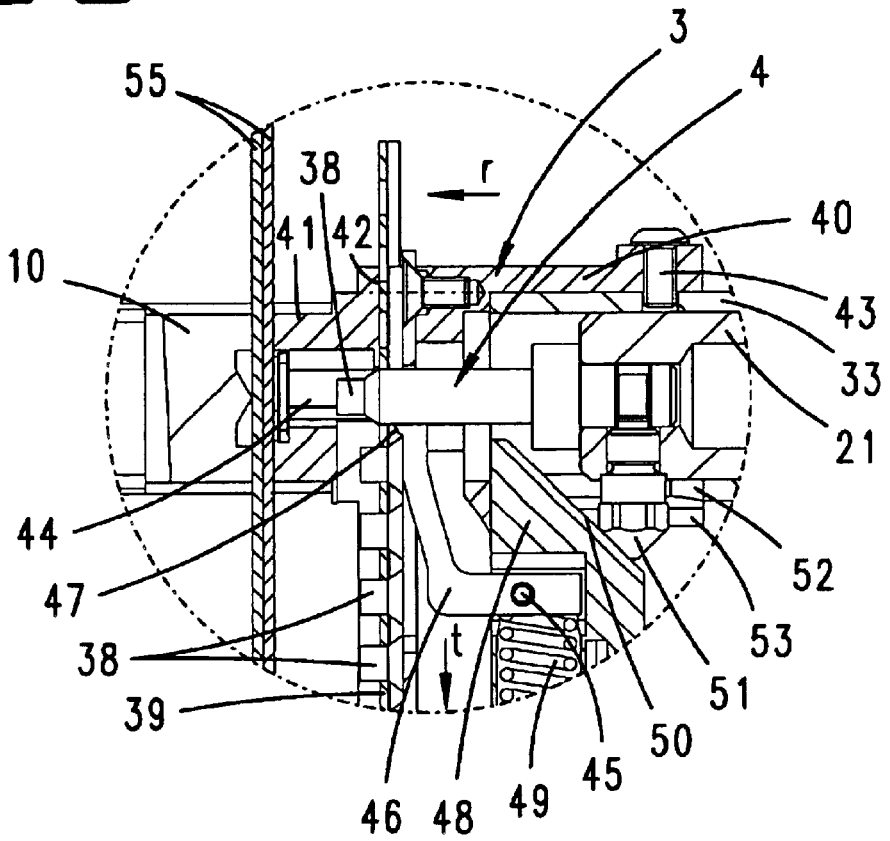
FIG. 8 shows the enlargement of the region VIII—VIII in FIG. 7.

From the position according to FIG. 6, in which the elements 55 are secured, the further increasing pressure in the pressure chamber 15 causes the die piston 13 to be displaced relative to the holding-down piston 12 (see FIGS. 7 and 8). This relative displacement takes place counter to the force to which the holding-down piston 12 is subjected by the spring 28.

During this further forward displacement of the riveting die 4, the latter presses the rivet 38 which is to be processed out of the rivet chain 39 and conducts it, through the rivet through-opening 44 of the holding-down head 41 of the device 37, in the direction of the elements 55 which are to be connected, the disengagement element 51, furthermore, running along the control surface 50 of the advancement carriage 48 during this forward displacement.

Figure 9:
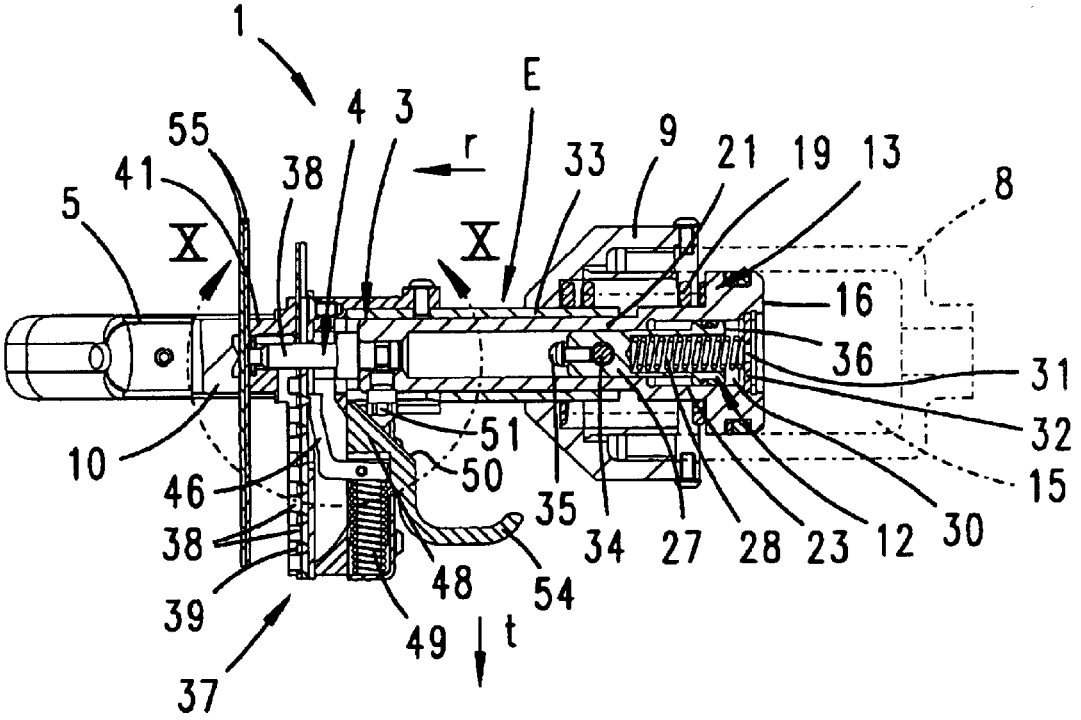
FIG. 9 shows a follow-up illustration to FIG. 7, with the rivet which has been carried along by the riveting die butting against the elements which are to be connected.
Figure 10:
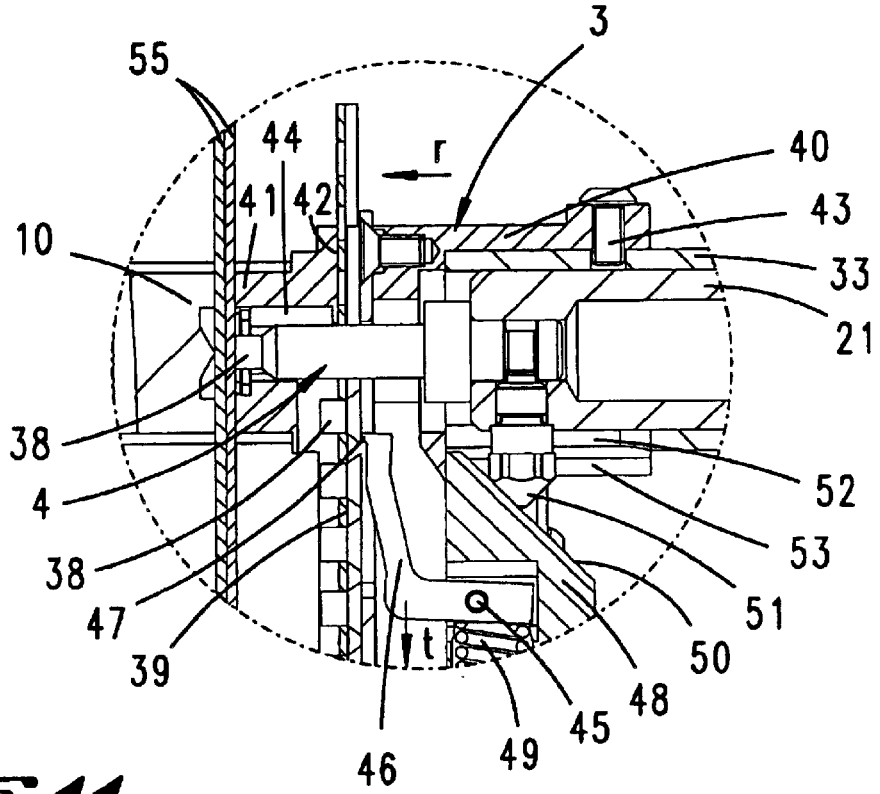
FIG. 10 shows the enlargement of the region X—X in FIG. 9.
Figure 11:
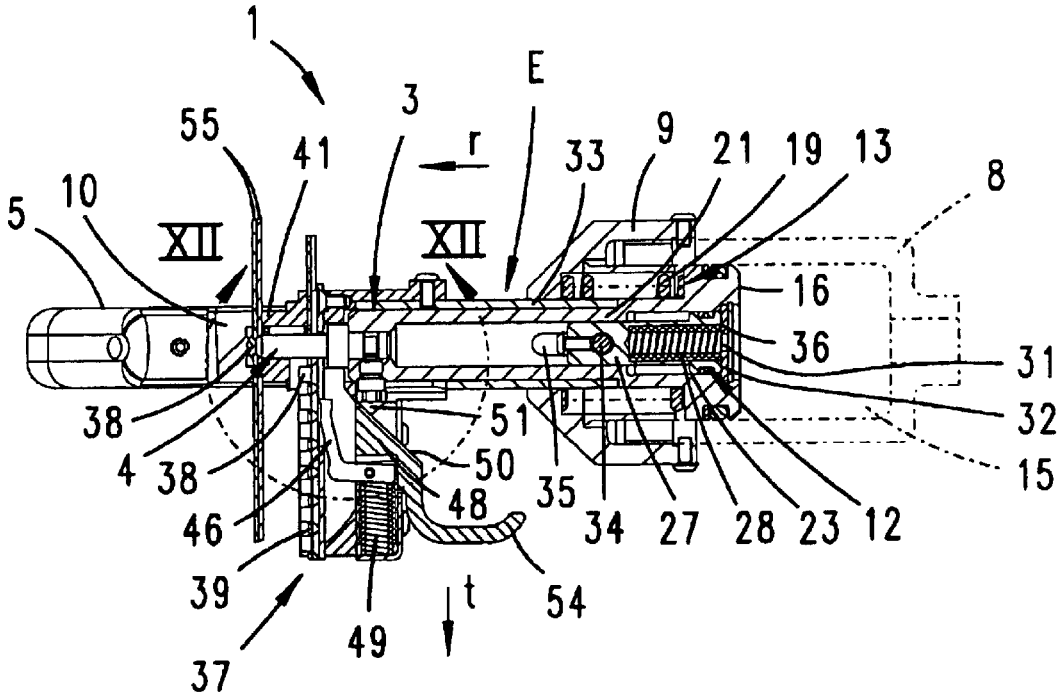
FIG. 11 shows a further follow-up illustration, relating to the riveting operation with the riveting die displaced forward to the full extent.
Figure 14:
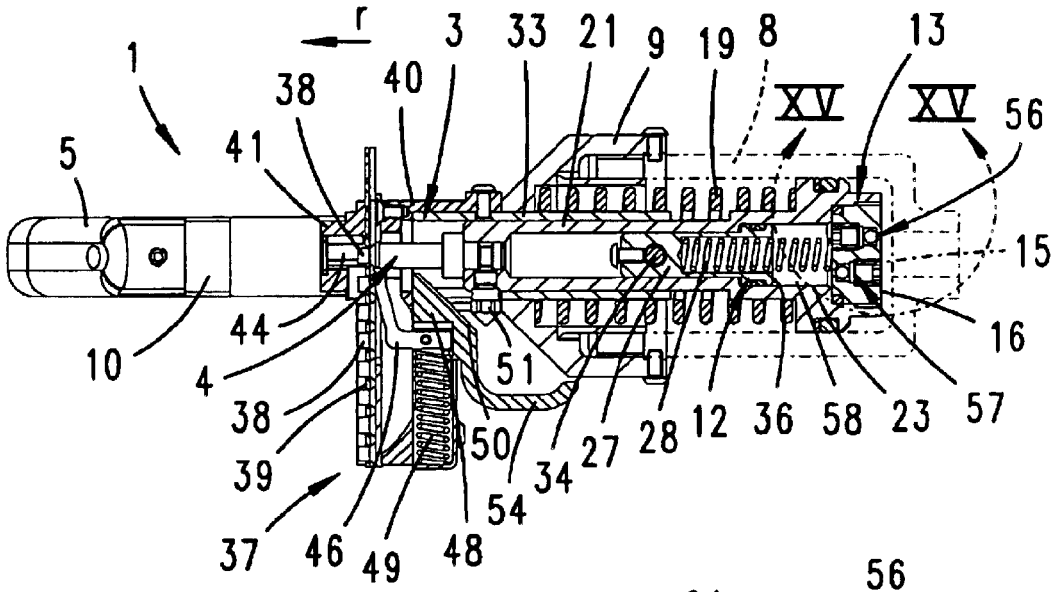
FIG. 14 shows an illustration corresponding to FIG. 4, but relating to the basic position of a riveting unit according to the invention in a second embodiment.
Figure 15:
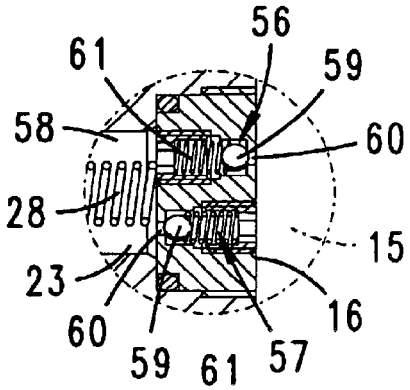
FIG. 15 shows the enlargement of the region XV—XV in FIG. 14.

FIGS. 9 and 10 show an intermediate position in which the rivet 38 is located immediately in front of the elements 55 which are to be connected and the advancement carriage 48 has been displaced rearward in part counter to the force of the spring 49 by means of the disengagement element 51, with the advancement pawl 46 having been carried along in the process.

A further forward displacement of the riveting die 4 causes the elements 55 to be pierced by means of the rivet 38 which is to be processed, and in this case is bent rearward by the rivet anvil 10, which forms a female die, in order to form the rivet connection. At the same time, a further rearward displacement of the advancement carriage 48 and thus of the advancement pawl 46 takes place, into a position in which the advancement tip 47 of the advancement pawl 46 is located behind a rivet 38 which is the next to be processed.

Once riveting has taken place, the pressure in the pressure chamber 15 exceeds a predetermined value, which results in the opening of a return valve in the operating unit 2. As a result of this, the hydraulic cylinder of the operating unit 2 moves back, which, on account of the spring biasing, results in simultaneous rearward displacement of holding-down means 3 and riveting die 4 as well as holding-down piston 12 and die piston 13. During this rearward displacement, it is also the case that the advancement carriage 48, on account of not being supported by the disengagement element 51, moves back again in the direction of its starting position, with the rivet 38 in the rivet chain 39 which is next to be processed being displaced forward by the advancement pawl 46 advancing it into the axial operating position according to FIG. 5. In this position, the advancement pawl 46 strikes with stop-limited action against the riveting die 4. Since the riveting-die cross-section is always adapted to that of the riveting head, the same advancement device 37 can be used to process rivet chains 39 with rivets 38 of different sizes.

FIGS. 14 to 18 show a second embodiment of the riveting unit according to the invention, in the case of which the cylinder 23 in which the holding-down piston 12 is guided has a hydraulic volume 58 which is shut off in the outward direction, i.e. in the direction of the pressure chamber 15, by means of valves 56, 57 which switch in a pressure-dependent manner. These valves 56, 57 are substantially formed from in each case a valve ball 59 which closes a through-passage opening 60, with the balls 59 in the process being biased into the closure position by means of compression springs 61 acting on them from the rear side.

In the case of this embodiment, a riveting operation is initiated in that, by virtue of the force acting on the effective surface area 16 of the die piston 13, the riveting-die/holding-down means unit E is displaced forward uniformly, i.e. without the holding-down means 3 and riveting die 4 being displaced relative to one another, in the direction of the rivet anvil 10, until it reaches a position in which the elements 55 which are to be connected are clamped in between the holding-down head 41 of the device 37 and the rivet anvil 10. The thereafter further increasing pressure acting on the die-piston surface 16 causes, via the now supporting holding-down means 3, an increase in pressure in the hydraulic volume 58, which is initially shut off between the valves 56, 57 and the holding-down piston 12. If this pressure exceeds a preset value, then the outlet valve 57, which forms a positive-pressure valve, opens by virtue of its ball 59 being displaced counter to the force of the compression spring 61, whereupon the hydraulic fluid can pass out in the direction of the pressure chamber 15. This ensures displacement of the die piston 13 relative to the holding-down piston 12, for the purpose of carrying out the riveting operation.

It is also the case with this exemplary embodiment that during the forward displacement of the riveting die 4, or during the riveting operation, the device 37 causes the next rivet 38 to be displaced into a standby position by means of the advancement pawl 46.

During the return movement, which is brought about by the decrease in pressure in the pressure chamber 15, the rearward displacement, assisted by means of the spring 28, of the holding-down piston 12, in the region between the same and the valves 56, 57, produces a negative pressure which causes the inlet valve 56, which forms a nonreturn valve, to open for the purpose of the hydraulic fluid to pass in again.

Figure 16:
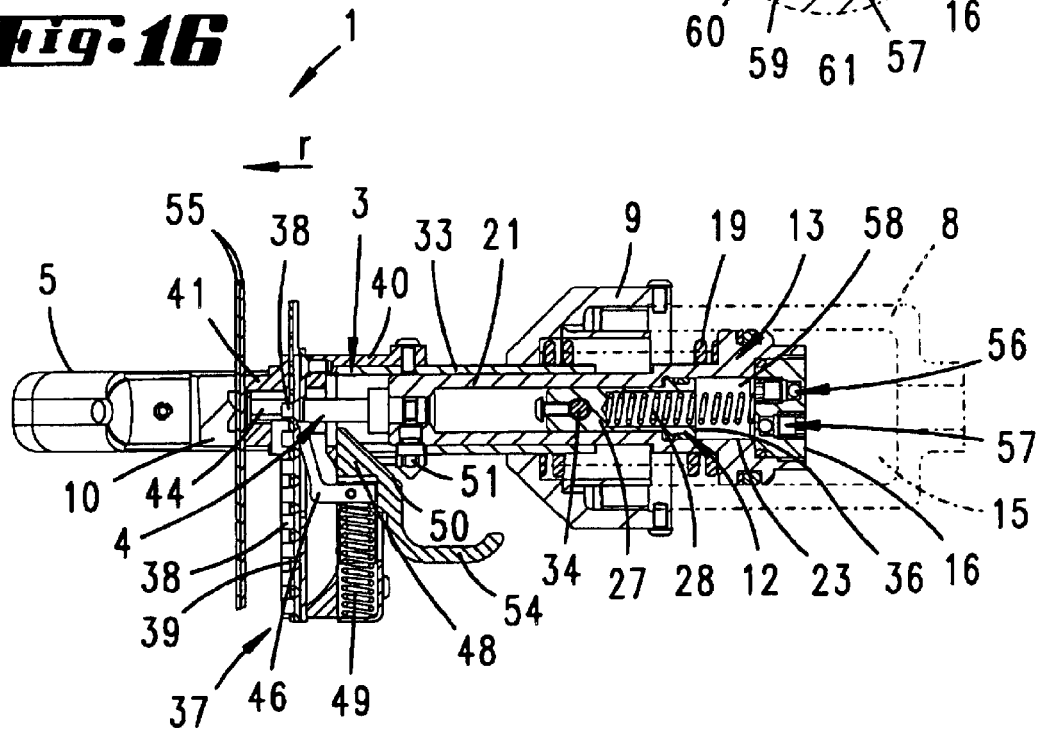
FIG. 16 shows an illustration corresponding to FIG. 7, but relating to the embodiment according to FIG. 14.
Figure 17:
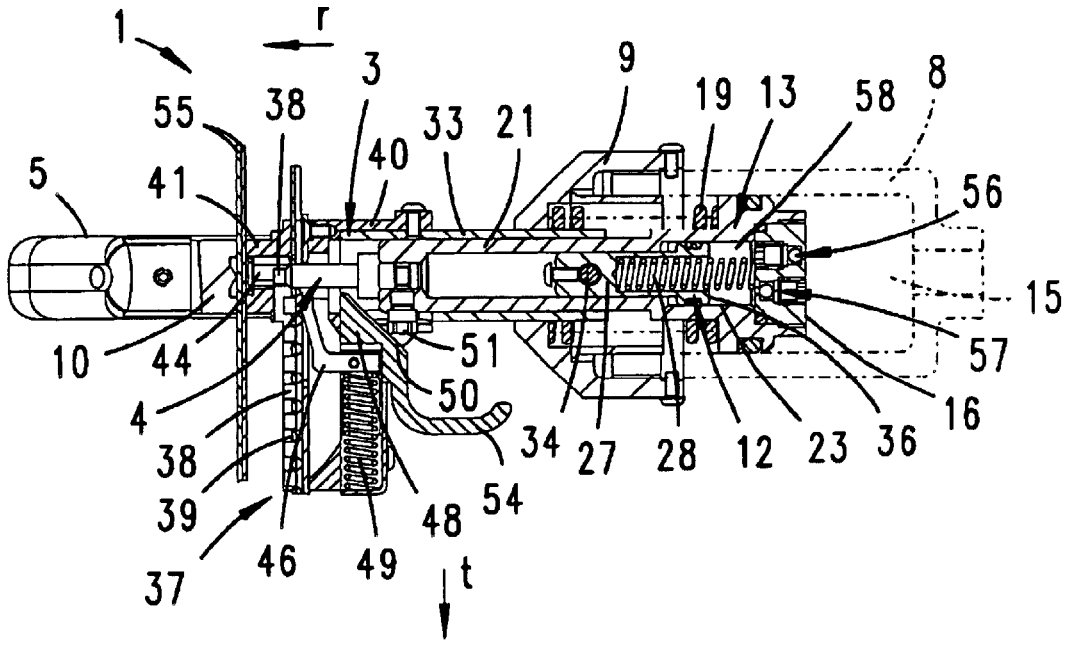
FIG. 17 shows an illustration corresponding to FIG. 9, likewise relating to the second embodiment.
Figure 18:
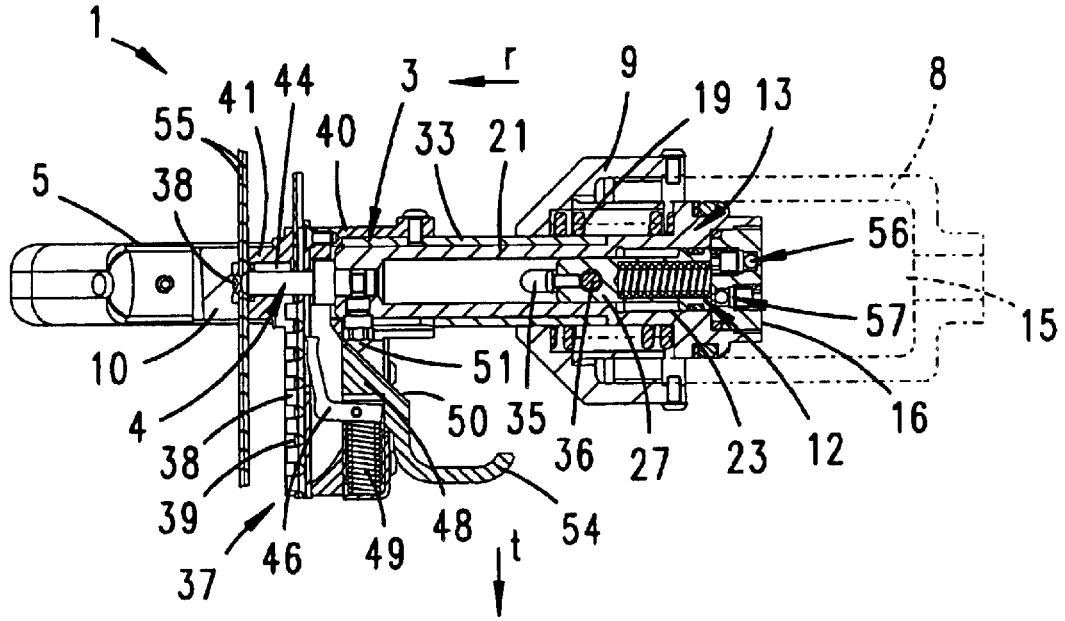
FIG. 18 shows the riveting position according to FIG. 11 in the second embodiment.
Figure 19:
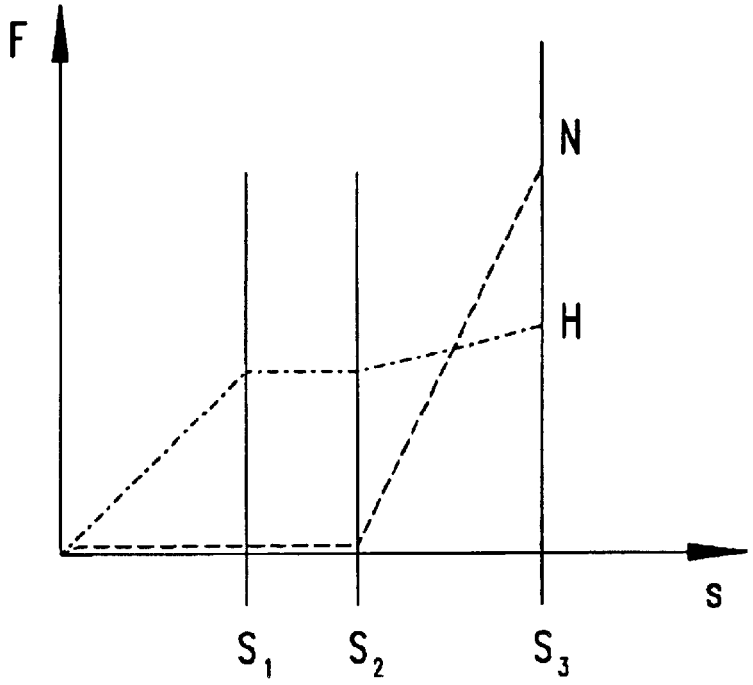
FIG. 19 shows a diagram for illustrating the dependence of the holding-down force and riveting-die force as a function of the displacement distance of the respective holding-down means and riveting die.

Relatively high holding-down forces are advantageously achieved in the case of this embodiment. As can be gathered from the force diagram in FIG. 19, during the riveting operation, the holding-down force H is increased in dependence on the riveting-die force N, but to a lesser extent, the holding-down force H, furthermore, being increased starting from a level which initially exceeds the riveting-die force N. It can be gathered that the holding-down force H increases constantly, over a distance S1, until the abutment position according to FIG. 16 is reached, the riveting-die force N remaining in the vicinity of zero over the same distance. Over the distance to S2 which is then to be covered, and in which the riveting die 4, with the carried-along rivet 38, is positioned on the elements 55, the holding-down force H remains substantially the same, in this case too with a riveting-die force in the vicinity of zero. It is only when a rivet 38 is pressed through the elements 55 (distance S2–S3) that the riveting-die force N increases more or less abruptly, this being accompanied by a moderate increase in the holding-down force H.

Figure 20:
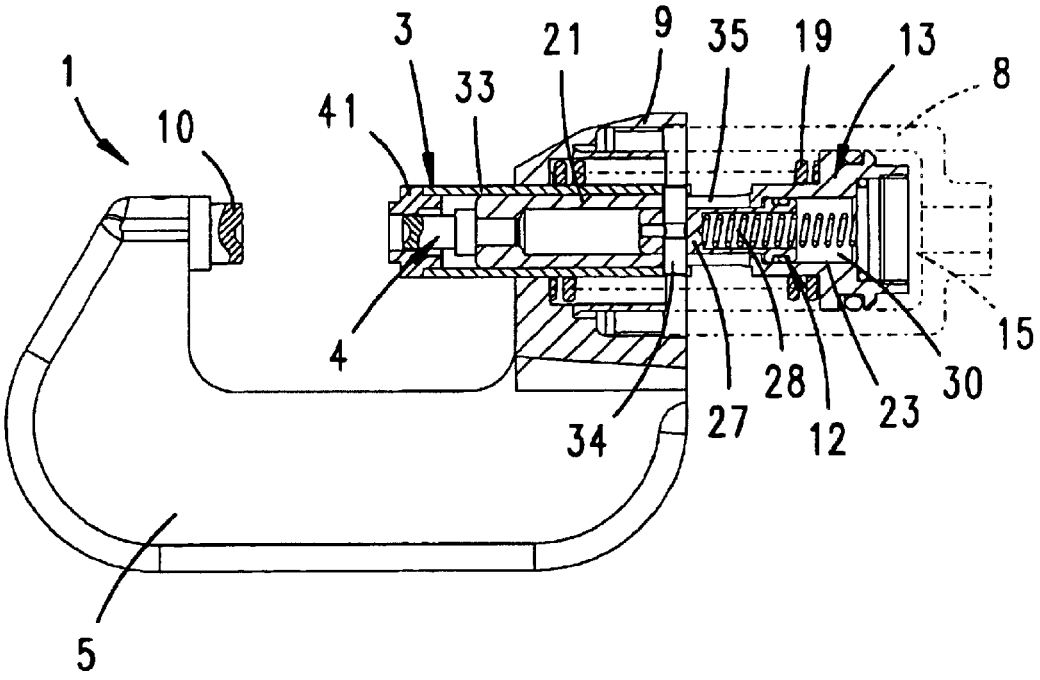
FIG. 20 shows the view of a riveting unit, partially in section in a third embodiment.
Figure 21:
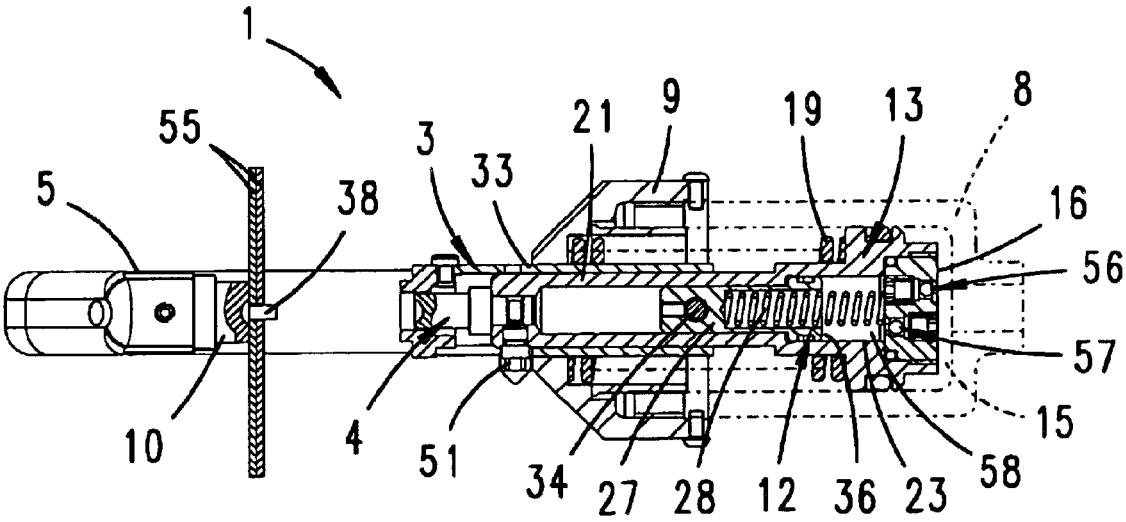
FIG. 21 shows a further illustration corresponding to FIG. 4, but relating to the embodiment according to FIG. 20.
Figure 22:
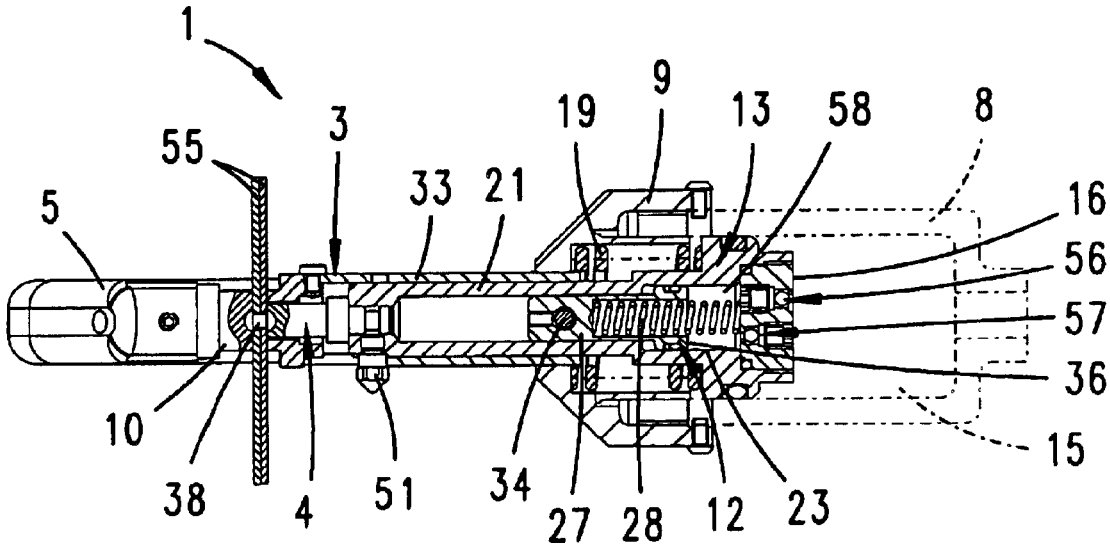
FIG. 22 shows a follow-up illustration to FIG. 21, relating to the riveting position.
Figure 23:
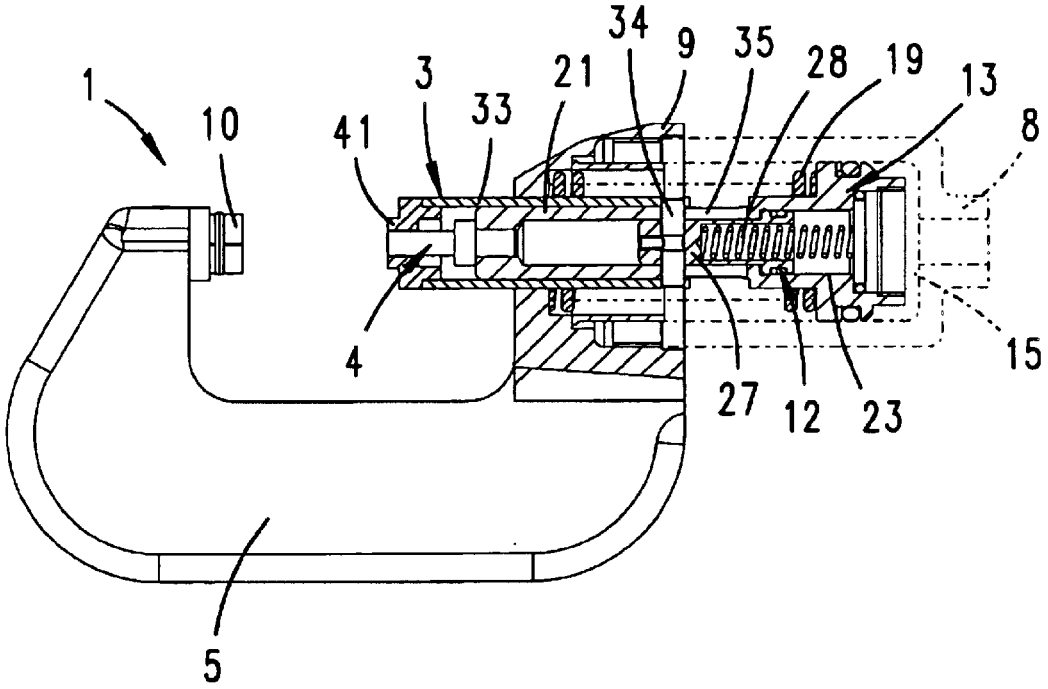
FIG. 23 shows an illustration corresponding to FIG. 20, but relating to a fourth embodiment.

FIGS. 20 to 22 show a third embodiment, in the case of which two elements 55, already provided with a straight rivet 38, are fastened to one another by means of riveting. For this purpose, the rivet anvil 10 is shaped appropriately for accommodating the riveting head. Correspondingly, the riveting die 4 also has a negative shape at its end, for the purpose of deforming the free end of the rivet shank. It is advantageously possible to use, for this purpose, a riveting unit 1 according to the first or second embodiment, in which the device for feeding rivets has been removed, whereupon the free end of the holding-down means 3 also forms the holding-down head 41 at the same time. Furthermore, the riveting die 4, which in the previously described exemplary embodiments is formed with a smooth surface at the end, is changed for a riveting die 4 having the hollow shape of a rivet.

Finally, FIGS. 23 to 26 illustrate a further embodiment, in the case of which the elements 55 are joined, without using a rivet, merely by deformation by means of the riveting die 4. According to the previously described exemplary embodiment, it is also the case here that the free end of the holding-down means 3 forms the holding-down head 41, the smooth end surface of the riveting die 4, in the starting position according to FIGS. 23 and 24, being aligned with the end surface of the holding-down head 41.

The rivet anvil 10 has two joining wings 62 which can be moved in opposite directions to one another and engage over the rivet anvil 10 in part, in the process leaving between them a spacing a corresponding to the diameter of the riveting die 4.

The rivet-anvil opening left between the joining wings 62 is designated 64.

Figure 24:
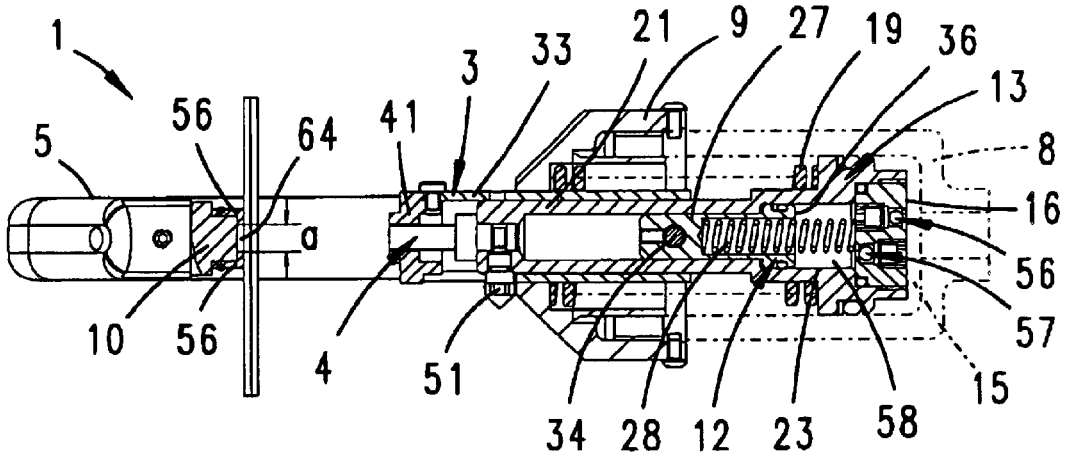
FIG. 24 shows an illustration corresponding to FIG. 21, but relating to the embodiment according to FIG. 23.
Figure 25:
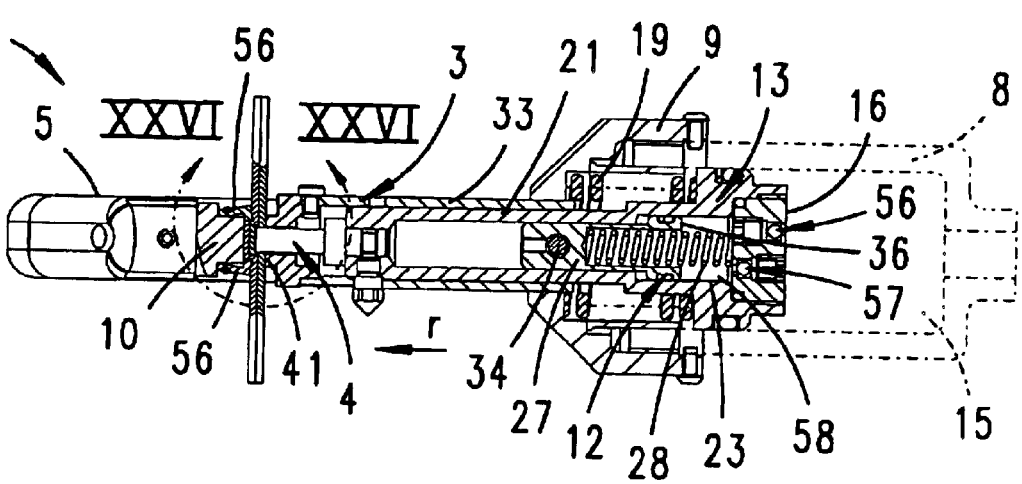
FIG. 25 shows the riveting or joining position in an illustration according to FIG. 24.
Figure 26:
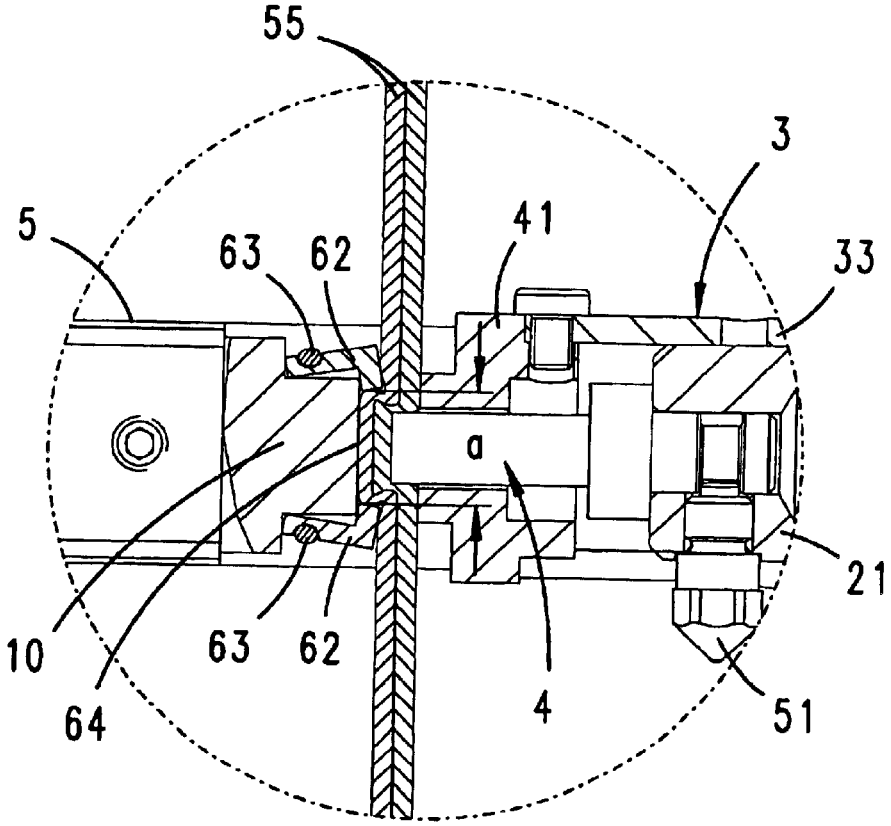
FIG. 26 shows the enlarged region XXVI—XXVI in FIG. 25.

The joining wings 62 are mounted in a moveable manner on the rivet anvil 10 about pins 63 transverse to the movement direction r of the riveting die 4, the pins 63, in the exemplary embodiment illustrated, being formed by a spring ring which forces the joining wings 62 into the starting position according to FIG. 24.

Following abutment of the holding-down means 3 against the elements 55, the riveting die moves downward, the joining wings 62 being displaced by means of the material of the elements 55 which are to be connected to one another being displaced laterally by the riveting die 4, the spacing a between these joining wings being increased in the process. In this case, during the displacement, the joining wings 62 dig into the material of the elements 55 which are to be connected, in part counter to the movement of the riveting die 4, whereupon joining, in particular press-joining, between the elements 55 has been achieved.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

What is claimed is:

1. A riveting unit (1) with a holding-down means (3) and a riveting die (4), the holding-down means (3) and the riveting die (4) driveable hydraulically by means of a holding-down piston (12) and of a die piston (13), characterized in that the holding-down piston (12) and the die piston (13) are activated by the same hydraulic pressure, the effective piston area (36) of the holding-down piston (12) being formed to be smaller than the effective piston area (16) of the die piston (13).

2. The riveting unit as claimed in claim 1, characterized in that the holding-down piston (12) is disposed within the die piston (13), which is formed as an annular piston, and the holding-down piston (12) is coupled to the holding-down means (3) by engaging radially through the die piston (13).

3. The riveting unit as claimed in claim 1, characterized in that the holding-down piston (12) and the die piston (13) are each biased in their starting position by means of a spring (19, 28), the spring (19) of the die piston (13) being set to a stronger setting than the spring (28) of the holding-down piston (12).

4. The riveting unit as claimed in claim 3, characterized in that the springs (19, 28) are disposed concentrically in relation to one another.

5. The riveting unit as claimed in claim 1, characterized in that the die piston (13) forms a central cylinder (23) in which the holding-down piston (12) is disposed.

6. The riveting unit as claimed in claim 5, characterized in that a restoring spring (28) of the holding-down piston (12) is supported against a pressure-exerting disk (32), which is disposed in the inlet region of the cylinder (23) and leaves a through-passage (31).

7. The riveting unit as claimed in claim 1, characterized in that the holding-down means (3) and the riveting die (4) are formed, over part of their length, as sleeve bodies (33, 21) which are disposed concentrically in relation to one another and can be displaced axially in relation to one another.

8. The riveting unit as claimed in claim 7, characterized in that a cylinder (21) in which the holding-down piston (12) is guided has a hydraulic volume (58) which is shut off in an outward direction by means of valves (56, 57).

9. The riveting unit as claimed in claim 8, characterized in that the valves (56, 57) are used to set a holding-down force (H) which is uniform until the riveting operation is carried out.

10. A method of riveting two sheet-like elements (55) by means of a riveting device having holding-down means (3) and a riveting die (4), wherein in a first step the holding-down means (3) being moved into abutment against the elements (55) while, in a second step, the riveting die (4) is pressing a rivet into the elements (55), connecting the latter in the process, or is joining the elements directly to one another, characterized in that the holding-down force (H) is increased in dependence on the die force (N), but to a lesser extent.

11. The method as claimed in claim 10, characterized in that the holding-down force (H) is increased starting from a level at the beginning exceeding the riveting-die force (N).

* * * * *

UNITED STATES PATENT AND TRADEMARK OFFICE

CERTIFICATE OF CORRECTION

PATENT NO. : 6,862,793 B2
DATED : March 8, 2005
INVENTOR(S) : Egbert Frenken

It is certified that error appears in the above-identified patent and that said Letters Patent is hereby corrected as shown below:

Column 1,
Line 39, "invention. involved" should be -- invention. It is advantageously possible for the components involved --

Column 4,
Line 59, "quotation" should be -- question --

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,862,793 B2
DATED : March 8, 2005
INVENTOR(S) : Egbert Frenken

It is certified that error appears in the above-identified patent and that said Letters Patent is hereby corrected as shown below:

Column 1,
Line 39, "invention. involved" should be -- invention. It is advantageously possible for the components involved --

Column 4,
Line 59, "quotation" should be -- question --

Signed and Sealed this

Fourteenth Day of June, 2005

JON W. DUDAS
*Director of the United States Patent and Trademark Office*